US009030484B2

(12) United States Patent
Park et al.

(10) Patent No.: US 9,030,484 B2
(45) Date of Patent: May 12, 2015

(54) IMAGE SIGNAL PROCESSING APPARATUS AND METHOD THEREOF

(75) Inventors: Ji-yong Park, Suwon-si (KR); Sang-kyun Im, Nowon-gu (KR); Myung-jin Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1540 days.

(21) Appl. No.: 11/727,688

(22) Filed: Mar. 28, 2007

(65) Prior Publication Data

US 2008/0055653 A1 Mar. 6, 2008

(30) Foreign Application Priority Data

Aug. 30, 2006 (KR) ..... 10-2006-0083049

(51) Int. Cl.
*G09G 5/02* (2006.01)
*G09G 3/20* (2006.01)

(52) U.S. Cl.
CPC ..... *G09G 3/2055* (2013.01)

(58) Field of Classification Search
CPC ..... G09G 3/2044
USPC ..... 345/596; 358/3.19; 382/283
See application file for complete search history.

(56) References Cited

U.S. PATENT DOCUMENTS

| | | | | |
|---|---|---|---|---|
| 4,937,677 | A * | 6/1990 | van Dorsselaer | 358/451 |
| 6,219,838 | B1 | 4/2001 | Cherichetti et al. | |
| 2006/0182183 | A1* | 8/2006 | Winger | 375/240.27 |
| 2007/0024636 | A1* | 2/2007 | Lo | 345/596 |

FOREIGN PATENT DOCUMENTS

| | | |
|---|---|---|
| CN | 1622165 A | 6/2005 |
| CN | 1714377 A | 12/2005 |

* cited by examiner

*Primary Examiner* — Maurice L McDowell, Jr.
(74) *Attorney, Agent, or Firm* — Sughrue Mion, PLLC

(57) ABSTRACT

An image signal processing apparatus and a method thereof are disclosed. The image signal processing apparatus includes a random producing unit which produces seed values to a plurality of frames input for a predetermined period by using a linear feedback shift register (LFSR), and a dithering processing unit which carries out a dithering to input image signals by using the seed values produced by the random producing unit. With this construction, the apparatus can carry out the dithering without using a frame buffer, thereby allowing a high-definition image to be realized.

18 Claims, 6 Drawing Sheets

IMAGE SIGNAL PROCESSING APPARATUS AND METHOD THEREOF

CROSS-REFERENCE TO RELATED APPLICATIONS

This application claims the priority from Korean Patent Application No. 10-2006-0083049, filed Aug. 30, 2006, in the Korean Intellectual Property Office, the disclosure of which is incorporated by reference in its entirety.

BACKGROUND OF THE INVENTION

1. Field of the Invention

Methods and apparatuses consistent with the present invention relate generally to an image signal processing, and more particularly, to an image signal processing capable of carrying out a dithering without using a frame buffer.

2. Description of the Related Art

An image signal processing apparatus, such as a plasma display panel (PDP), which processes image signals to display on a screen, receives the image signals including broadcasting signals from various image outputting media, such as a video cassette recorder (VCR) and a digital video disk (DVD) player, to reproduce on the screen. Once image signals are received, the image signal processing apparatus reproduces processing image signals of red (R), green (G) and blue (B), and to enhance luminance characteristics, carries out reverse gamma compensation to the image signals of red (R), green (G) and blue (B).

However, when the reverse gamma compensation is carried out, noise occurs in low gradation areas and thus image quality is deteriorated. To prevent such a deterioration of the image quality, a dithering is carried out. A conventional dithering method is described with reference to FIG. 1 as follows.

FIG. 1 is a schematic block diagram illustrating a conventional image signal processing apparatus.

Referring to FIG. 1, the conventional image signal processing apparatus includes a random producing unit 10, a frame buffer 30, a dithering processing unit 50, and an adding unit 70.

The random producing unit 10 produces seed values for respective frames f of input image signals. At this time, the random producing unit 10 produces a seed value for every M×N position of each of the frames f by using position (x, y) information of pixels. Here, the seed value is a value for determining a mask matrix, which is used in carrying out a dithering at the dithering processing unit 50 to be described later.

The seed values produced from the random producing unit 10 are stored in the frame buffer 30 for one period, and the dithering processing unit 50 determines mask matrixes by using the seed values stored in the frame buffer 30 and then carries out the dithering process by using the mask matrixes. A period includes more than one frame, and whenever the period is changed, new seed values are produced from the random producing unit 10 and are stored in the frame buffer 30.

The adding unit 70 adds the dithered image signals to the input image signals r, g and b and outputs image signals r', g', and b' with improved image quality.

Here, to carry out a spatial dithering, the seed values produced with respect to M×N positions of each of the frames are used, and to carry out a temporal dithering, the seed values stored in the frame buffer 30 for the one period are used. However, it is expensive to implement in hardware or to physically embody the frame buffer 30 in the image signal processing apparatus. On the other hand, if the image signal processing apparatus is not equipped with the frame buffer 30, it is impossible to carry out the temporal dithering and thus to realize a high-definition image.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above. The present invention provides an image signal processing apparatus, which can carry out a dithering by using a linear feed back shift register (LFSR) instead of a frame buffer, thereby allowing fabrication costs to be reduced and allowing a high-definition image to be realized, and an image signal processing method thereof.

According to an aspect of an exemplary embodiment of the present invention, there is provided an image signal processing apparatus, including a random producing unit to produce seed values for a plurality of frames input for a predetermined period by using a linear feedback shift register, and a dithering processing unit to carry out a dithering to input image signals by using the seed values produced by the random producing unit.

Here, the random producing unit may produce the seed values for the plurality of frames input for the predetermined period to be identical to one another.

The random producing unit may change the seed values by updating an initial value of the linear feedback shift register.

Here, the random producing unit may update the initial value of the linear feedback shift register when the predetermined period is changed.

Also, the random producing unit may update an initial value of the linear feedback shift register when a remainder is output as a value of '0' after frame counting values obtained by counting the number of frames of the input image signals are divided by the predetermined period.

Preferably, but not necessarily, the random producing unit updates the initial value of the linear feedback shift register when a new frame is determined to be input.

The random producing unit may control the linear feedback shift register to carry out an exclusive OR (XOR) function and thus to output the seed values according to position changes of pixels included in at least one frame.

Preferably, but not necessarily, the dithering processing unit selects mask matrixes for dithering the input image signals by using frame counting values, obtained by counting the number of frames of the input image signals, and the seed values.

Preferably, but not necessarily, the random producing unit includes an initial value producing unit to produce the same initial value for one period, and a register processing unit to register the initial value produced by the initial value producing unit in the linear feedback shift register and to produce seed values according to position changes of respective pixels included in one frame.

According to another aspect of an exemplary embodiment of the present invention, there is provided an image signal processing method including producing seed values for a plurality of frames input for a predetermined period by using a linear feedback shift register, and carrying out a dithering to input image signals by using the produced seed values.

At this time, the producing the seed values may include producing the seed values for the plurality of frames input for the predetermined period to be identical to one another.

The producing the seed values may include changing the seed values by updating an initial value of the linear feedback shift register.

The producing the seed values may further include updating the initial value of the linear feedback shift register when the predetermined period is changed.

Alternatively, the producing the seed values may include updating initial value of the linear feedback shift register when a remainder is output as a value of '0' after frame counting values obtained by counting the number of frames of the input image signals are divided by the predetermined period.

Preferably, but not necessarily, the producing the seed values further includes updating the initial value of the linear feedback shift register when a new frame is determined as input.

Also, the producing the seed values may include controlling the linear feedback shift register to carry out an exclusive OR (XOR) function and thus to output the seed values according to position changes of pixels included in at least one frame.

The carrying out the dithering may include selecting mask matrixes for dithering the input image signals by using frame counting values, obtained by counting the number of frames of the input image signals, and the seed values.

Preferably, but not necessarily, the producing the seed values includes producing the same initial value for one period, and registering the produced initial value in the linear feedback shift register and producing seed values according to position changes of respective pixels included in one frame.

BRIEF DESCRIPTION OF THE DRAWINGS

The above and other aspects of the present invention will become more apparent from the following description of exemplary embodiments, taken in conjunction with the accompanying drawings of which.

Throughout the drawings, the same drawing reference numerals will be understood to refer to the same elements, features, and structures.

DETAILED DESCRIPTION OF THE EXEMPLARY EMBODIMENTS

The matters defined in the description such as a detailed construction and elements are provided to assist in a comprehensive understanding of the embodiment of the invention and are merely exemplary. Accordingly, those of ordinary skill in the art will recognize that various changes and modifications of the embodiment described herein can be made without departing from the scope and spirit of the invention. Also, descriptions of well-known functions and constructions are omitted for clarity and conciseness.

Figure 1:
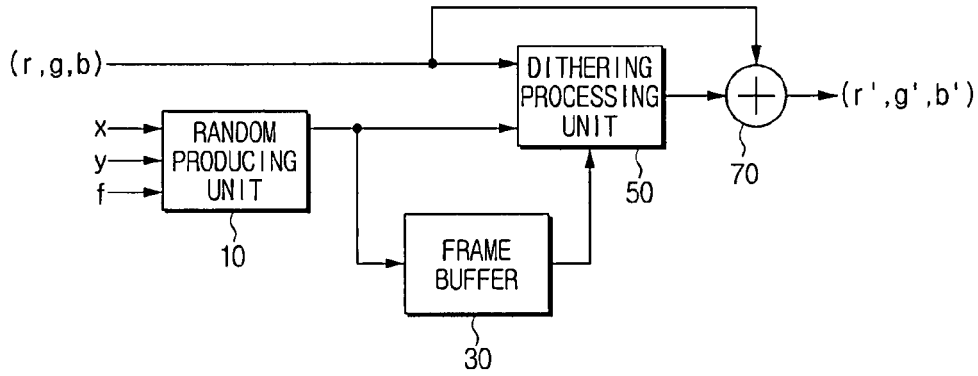
FIG. 1 (RELATED ART)
FIG. 1 is a schematic block diagram illustrating a conventional image signal processing apparatus.
Figure 2:
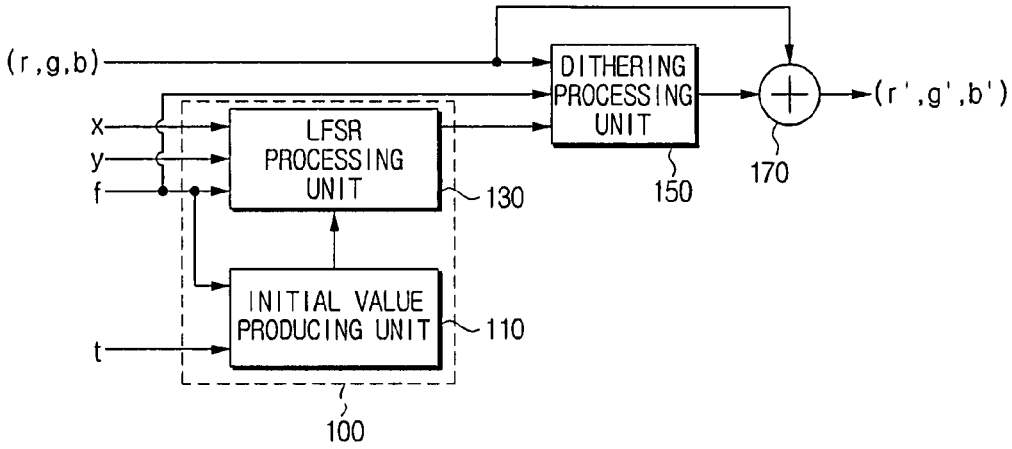
FIG. 2 is a schematic block diagram Illustrating a an image signal processing apparatus according to an exemplary embodiment of the present invention.

FIG. 2 is a schematic block diagram illustrating an image signal processing apparatus according to an exemplary embodiment of the present invention.

Referring to FIG. 2, the image signal processing apparatus includes a random producing unit 100, a dithering processing unit 150, and an adding unit 170.

Figure 6:
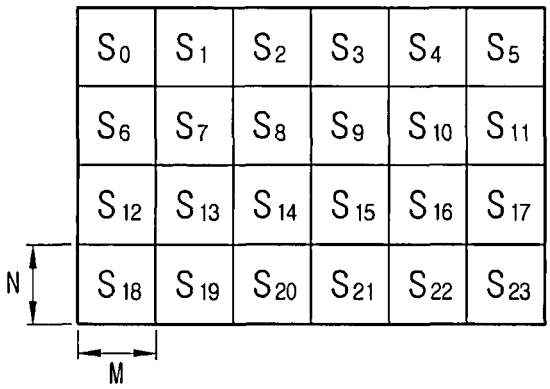
FIG. 6 is a view illustrating an output of the random producing unit provided in the image signal processing apparatus according to an exemplary embodiment of the present invention.

The random producing unit 100 produces seed values and provides them to the dithering processing unit 150 to be described later. That is, as illustrated in FIG. 6, the random producing unit 100 provides seed values produced for every M×N position to the dithering processing unit 150 for one period T. The random producing unit 100 includes an initial value producing unit 110 to produce the same initial value for the one period, and a linear feedback shift register (LFSR) processing unit 130 to produce seed values according to position (x, y) changes of respective pixels included in one frame f by using the initial value produced by the initial value producing unit 110. Here, the period T is set by user, so that one period T includes more than one frame f.

The dithering processing unit 150 determines mask matrixes by using the seed values provided from the random producing unit 100 and counting values obtained by counting the number of input frames. In addition, the dithering processing unit 150 carries out a dithering to input image signals r, g, and b by using the determined mask matrixes.

The adding unit 170 adds the dithered image signals to the input image signals r, g, and b and outputs image signals r', g', and b' with improved image quality.

Figure 3:
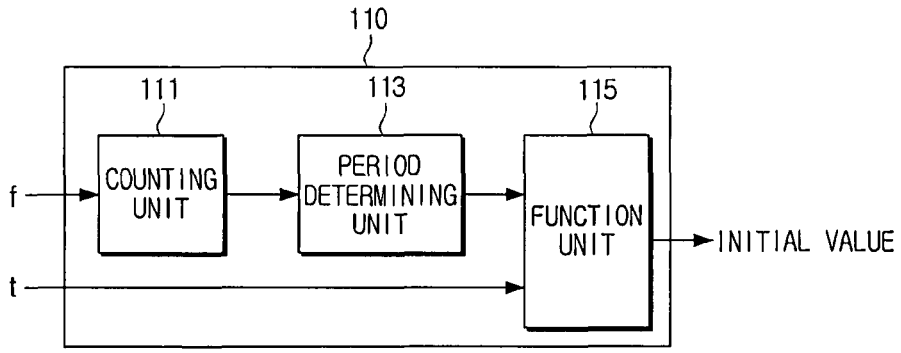
FIGS. 3 and 4 are block diagrams illustrating an operation of a random producing unit provided in the image signal processing apparatus according to an exemplary embodiment of the present invention.
Figure 4:
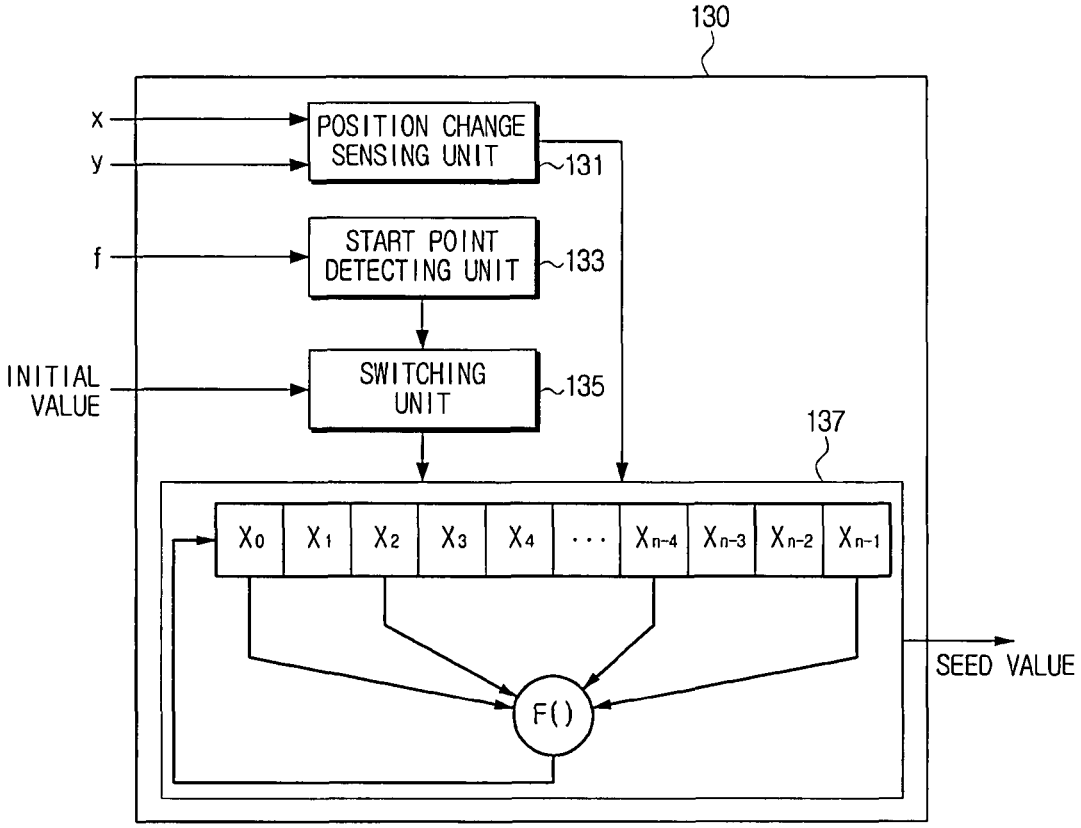

FIGS. 3 and 4 are block diagrams illustrating an operation of the random producing unit 100 provided in the image signal processing apparatus according to an exemplary embodiment of the present invention.

Referring to FIG. 3, the initial value producing unit 110 includes a counting unit 111, a period determining unit 113, and a function unit 115.

The counting unit 111 counts the number of the input frames f, and outputs frame counting values fcnt. The period determining unit 113 determines whether the period T is changed to a frame, which is input at present, by using the frame counting values. That is, the period determining unit 113 determines that the period T is changed when a remainder fcnt % T is output as a value of '0' after the frame counting values fcnt are divided by the period T.

The function unit 115 produces an initial value of a LFSR, which has a magnitude corresponding to the following EQN. [1], according to a clock t set therein when the value of '0' corresponding to a case that the period T is changed and is output from the period determining unit 113.

$$2^{LFSR_BIT} \geq Image_H_size \times Image_V_size \quad \text{EQN. [1]}$$

Here, the LSFR_BIT represents a bit number of the LSFR, the Image_H_size represents a horizontal magnitude of an input frame, and the Image_V_size represents a vertical magnitude of the input frame.

According to an analysis, EQN. [1] means that a magnitude of the LFSR should be larger than or identical to that of one frame of input images.

An example of an operation of the initial value producing unit 110 as described above is as follows. Assuming that the period T is '3', if 0 frames are input, the remainder comes to '0' and thus the function unit 115 produces an initial value. If 1 frame is input, the remainder comes to '1' and thus the function unit 115 does not produce an initial value. If 2 frames are input, the remainder comes to '2' and thus the function unit 115 also does not produce an initial value. Also, if 3 frames are input, the remainder comes to '0' and thus the function unit 115 produces an initial value. That is, the initial value of the LFSR is updated and output.

Referring to FIG. 4, the LFSR processing unit 130 includes a position change sensing unit 131, a start point detecting unit 133, a switching unit 135, and a LFSR 137.

The start point detecting unit 133 detects a start position of the input frame f, so that the switching unit 135 is turned on or off. That is, whenever a new frame f is input, the start point detecting unit 133 detects a start position of the input frame. At this time, preferably, but not necessarily, the start position of the input frame is detected before a picture displaying area is input.

The switching unit 135 switches the initial value produced by the initial value producing unit 110 explained with reference to FIG. 3 to deliver to the LFSR 137. To be more specific, when the start point detecting unit 133 outputs a signal indicating the start position of the frame f, the switching unit 135 is turned on, so that the initial value output from the initial value producing unit 110 is registered in the LFSR 137.

At this time, since the initial value producing unit 110 produces and outputs an initial value only when the period is changed, the LFSR 137 registers the same initial value for one period. For instance, assuming that a period T is '3', an initial value produced by the function unit 115 when 0 frames are input is registered in the LFSR 137 while 0 frames, 1 frame and 2 frames are input. Also, while 3 frames, 4 frames and 5 frames are input, an initial value updated by the function unit 115 when 3 frames are input is registered in the LFSR 137.

The position change sensing unit 131 senses position (x, y) changes of pixels included in an input frame, and transmits a value to the LFSR 137. That is, the position change sensing unit 131 outputs '1' if the position (x, y) of each of the pixels included in the input frame is determined as changed, and outputs '0' if the position (x, y) of each of the pixels is determined as not changed.

The LFSR 137 registers the initial value produced by the initial value producing unit 110, and carries out an operation represented as the following EQN. [2] according to the outputs from the position change sensing unit 131 to produce seed values.

$$LFSR_STATE=(LFSR_STATE<<1)+F(x_0,x_2,x_{n-4},x_{n-1}) \quad \text{EQN. [2]}$$

Here, the LFSR_STATE<<1 represents that the LFSR 137 is shifted, and the F( ) represents an exclusive OR (XOR) function. Also, the $x_0$,$x_2$,$x_{n-4}$, and $x_{n-1}$ are taps, which are calculated by the XOR function. The number of the taps is set by a user.

The LFSR 137 carries out the operation of the mathematical formula 2 to produce a seed value whenever the position change sensing unit 131 outputs '1'. At this time, an output bit number of the LFSR 137 is determined by the following EQN. [3].

$$O_BIT=\text{Round}(\log_2(M\times N)) \quad \text{EQN. [3]}$$

Here, the O_BIT represents the output bit number of the LFSR 137, that is, a magnitude of the seed value, and the Round( ) means a rounding off to the nearest integer. Also, the M×N represents a magnitude of the mask matrix.

Figure 5:
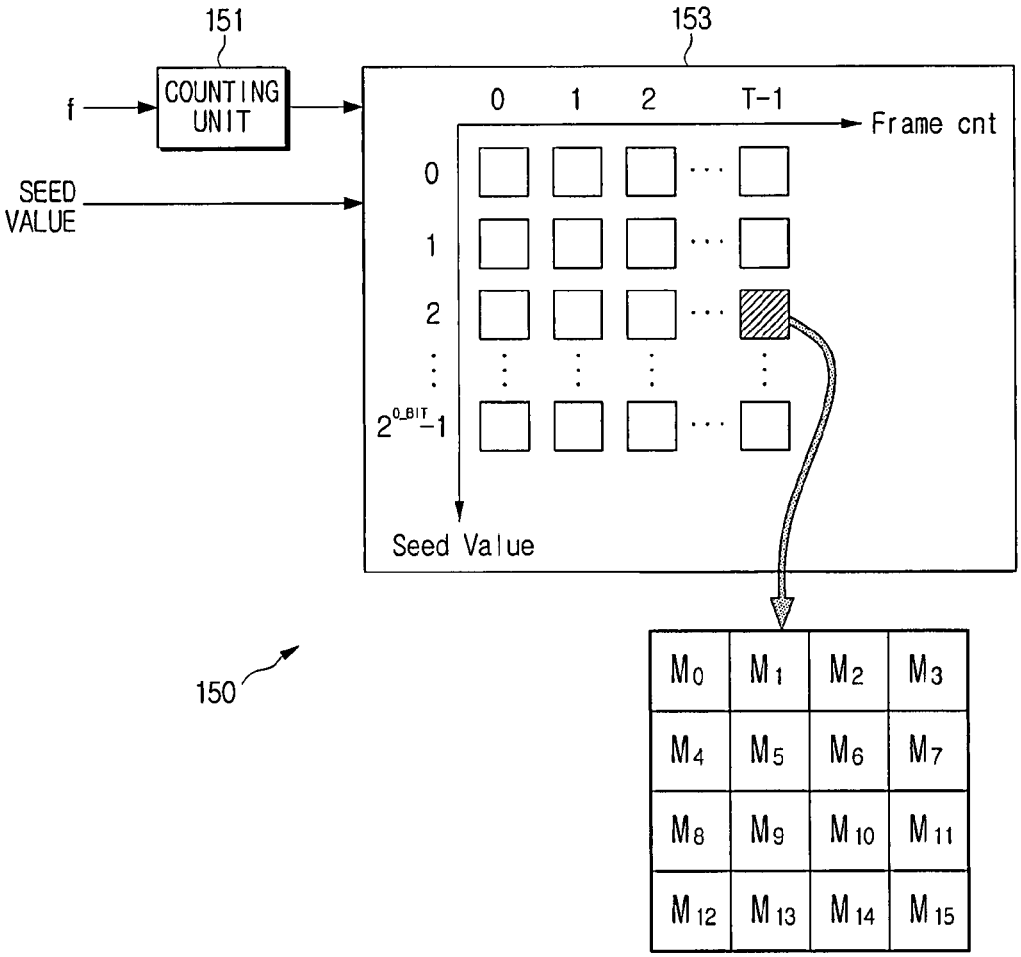
FIG. 5 is a block diagram illustrating an operation of a dithering processing unit provided in the image signal processing apparatus according to an exemplary embodiment of the present invention.

FIG. 5 is a block diagram illustrating an operation of the dithering processing unit 150 according to an exemplary embodiment of the present invention.

Referring to FIG. 5, the dithering processing unit 150 includes a counting unit 151, and a selecting unit 153.

The counting unit 151 counts the number of input frames f, and provides frame counting values frame cnt to the selecting unit 153.

As illustrated in FIG. 5, the selecting unit 153 selects mask matrixes by using the frame count values frame cnt and the seed values. That is, the selecting unit 153 selects a mask matrix for each of the input frames f according to the frame count values frame cnt, and selects a mask matrix every M×N position of one frame according to the seed values.

For instance, if a seed value is 2 and a frame count values frame cnt is T−1, a mask matrix corresponding thereto is selected, as illustrated in FIG. 5.

FIG. 6 is a view illustrating an output of the random producing unit 100 according to an exemplary embodiment of the present invention.

In FIG. 6 seed values are illustrated for one frame. The random producing unit 100 outputs different seed values for every M×N position of the one frame. Also, the random producing unit 100 outputs the same seed values, for example, the seed values illustrated in FIG. 6, for the same one period T. When the one period T is changed into the next period, the seed values produced and output every M×N position of the one frame are also changed and output.

Figure 7A:
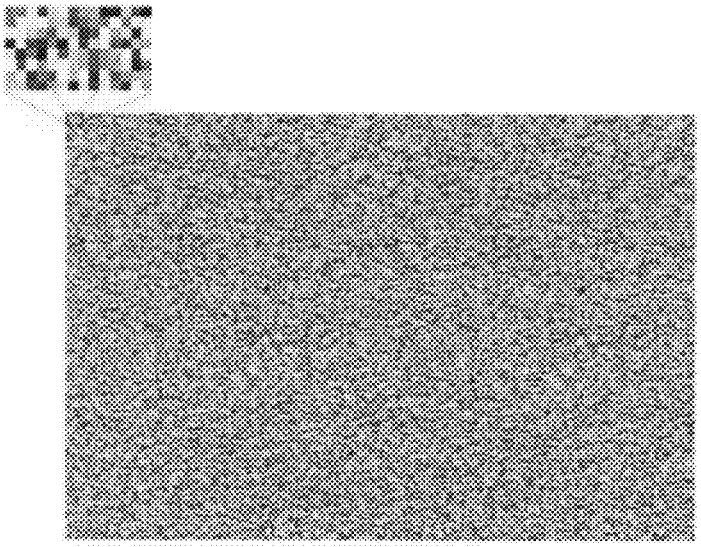
FIGS. 7A and 7B are views illustrating seed values of respective pixels according to a period in the image signal processing apparatus according to an exemplary embodiment of the present invention.
Figure 7B:
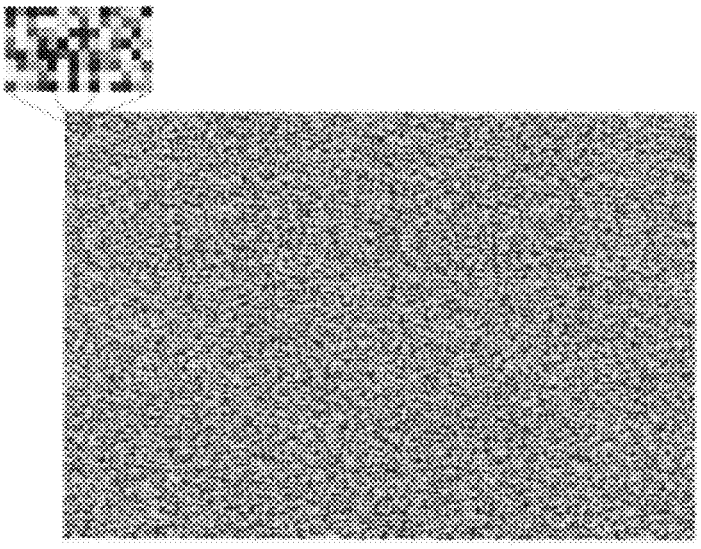

FIGS. 7A and 7B are views illustrating seed values of respective pixels according the period in the image signal processing apparatus according to an exemplary embodiment of the present invention.

FIG. 7A represents seed values of respective pixels for 0~(T1) period, and FIG. 7B represents seed values of respective pixels for T~(2T−1) period. As illustrated in FIGS. 7A and 7B, the seed values do not have spatial implications to one another, so that a pattern is not shown. Also, the respective seed values do not have implications for the same position every period, so that they are adapted in carrying out a temporal dithering as well as a spatial dithering.

Figure 8:
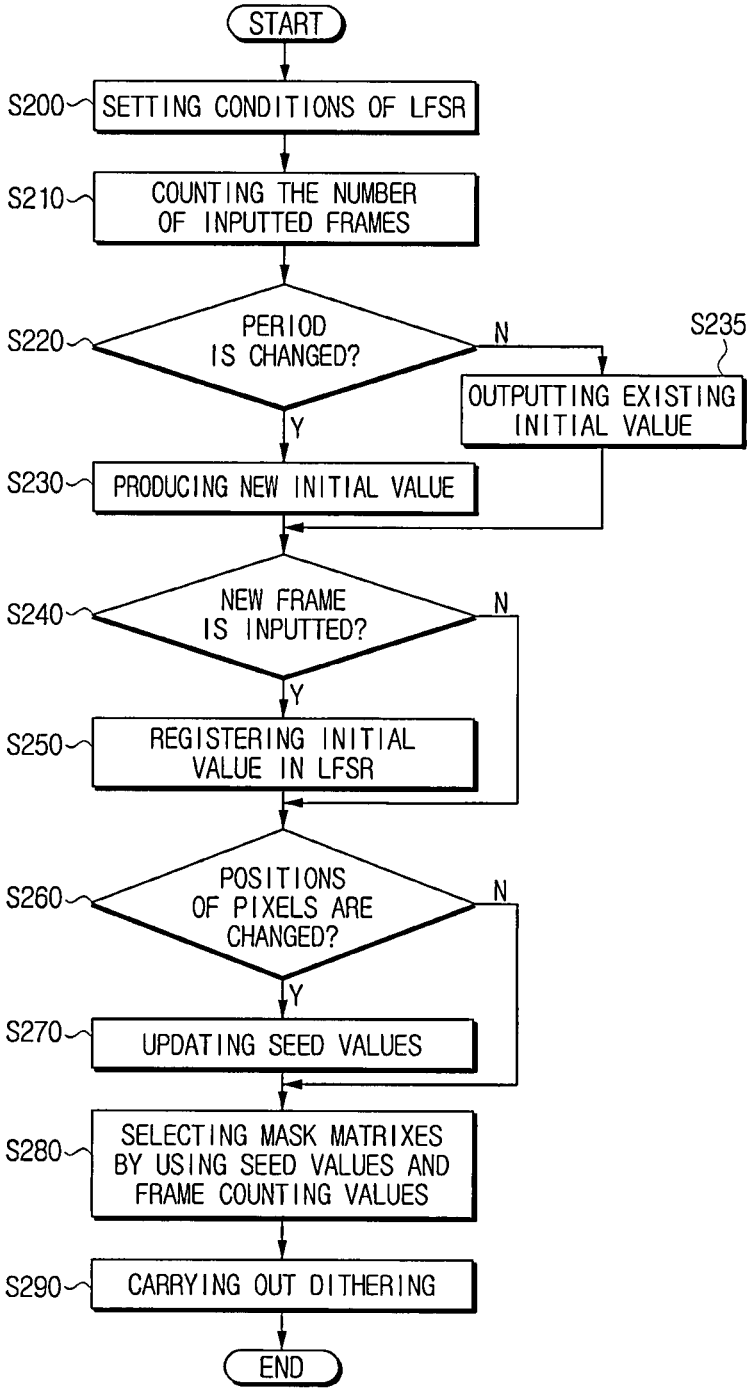
FIG. 8 is a flowchart illustrating an operation of the image signal processing apparatus according to an exemplary embodiment of the present invention.

FIG. 8 is a flowchart illustrating, an operation of the image signal processing apparatus according to an exemplary embodiment of the present invention.

Referring to FIG. 8, first, conditions for the LFSR 137 are set in advance by a user (S200). For example, the magnitude of the LFSR 137 is determined by EQN. [1], and an output bit number of the LFSR 137 is set having an output bit number such as the output bit number determined by the above-explained EQN [3]. Also, a tap number of LFSR 137 to be calculated by the XOR function is also set in advance by user.

After that, when image signals are input, the counting unit 111 counts the number of input frames f, and outputs frame counting values fcnt (S210). At this time, the period determining unit 113 determines whether a period T is changed, by using a remainder fcnt % T obtained by dividing the frame counting values fcnt by the period T (S220).

That is, if the remainder fcnt % T is '0', the period determining unit 113 determines that the period T is changed, and the function unit 115 produces a new initial value (S230). To the contrary, if the remainder fcnt % T is not '0', the period determining unit 113 determines that the period T is not changed, and the function unit 115 does not produce a new initial value, but outputs an existing initial value as it is (S235).

Next, the start point detecting unit 133 determines whether a new frame is input (S240). That is, if the start point detecting unit 133 detects a start position of frame and determines that a new frame is input, the switching unit 135 is turned on, so that the LFSR 137 registers the initial value produced by the function unit 115 (S250)

At this time, the position change sensing unit 131 senses whether positions of pixels are changed (S260). That is, if the position change sensing unit 131 senses a position (x, y) change of each of the pixels included in input one frame and determines that the position (x, y) of each of the pixels is changed, the position change sensing unit 131 outputs '1'. To the contrary, if the position change sensing unit 131 determines that the position (x, y) of each of the pixels is not changed, the position change sensing unit 131 outputs '0'.

When the position change sensing unit 131 outputs '1', the LFSR 137 carries out the operation represented as the above-described mathematical formula 2 according to the output from the position change sensing unit 131, and updates seed values (S270).

Next, the dithering processing unit 150 selects mask matrixes by using the seed values and the frame counting values counted by the counting unit 151 (S280), and carries out a dithering (S290).

With the process as described above, the image signal processing apparatus according to the exemplary embodiment of the present invention can carry out the temporal and the spatial dithering without using a frame buffer.

As apparent from the foregoing description, according to the exemplary embodiment of the present invention, the image signal processing apparatus and the method thereof carry out the dithering using the LFSR instead of the frame buffer, thereby allowing fabrication costs to be-reduced and allowing a high-definition image to be realized.

Although representative embodiment of the present invention has been shown and described in order to exemplify the principle of the present invention, the present invention is not limited to the specific embodiment. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. An image signal processing apparatus, comprising:

a random producing unit which produces seed values for frames input for a predetermined period, by using a linear feedback shift register (LFSR); and a dithering processing unit which performs a dithering to input image signals by using the seed values produced by the random producing unit, wherein the seed values produced by the LFSR are used by the dithering processing unit to select mask matrices from a plurality of mask matrices, the dithering processing unit uses the selected mask matrices to perform the dithering to produce dithered image signals, the random producing unit comprises an initial value producing unit which produces an initial value of the LFSR which produces the seed values based on the initial value, and wherein the initial value producing unit continuously counts a number of frames input to the random producing unit from the input image signals, divides the number of frames by a predetermined period, and updates the initial value to produce a new initial value each time a remainder of the number of frames divided by the predetermined period is zero.

2. The apparatus of claim 1, wherein the random producing unit produces the seed values for the frames input for the predetermined period to be identical to one another.

3. The apparatus of claim 1, wherein the random producing unit changes the seed values by updating the initial value of the LFSR.

4. The apparatus of claim 3, wherein the random producing unit updates the initial value of the LFSR if a new frame is determined to be input.

5. The apparatus of claim 1, wherein the random producing unit controls the LFSR to perform an exclusive OR (XOR) function and to output the seed values according to position changes of pixels included in at least one frame.

6. The apparatus of claim 1, wherein the dithering processing unit selects mask matrixes for dithering the input image signals by using frame counting values obtained by counting a number of the frames of the input image signals, and the seed values.

7. The apparatus of claim 1, wherein the initial value producing unit produces the same initial value for one period, and the random producing unit further comprises:

a register processing unit which registers the initial value produced by the initial value producing unit in the LFSR and produces seed values according to position changes of respective pixels included in one frame.

8. The apparatus of claim 1, wherein the dithering processing unit continuously counts a number of frames input to the dithering processing unit from the input image signals and generates a frame count value, and selects the selected mask matrices from the plurality of mask matrices which correspond to both the frame count value and the seed values.

9. The apparatus of claim 8, wherein the plurality of mask matrices are arranged in a matrix comprising a first axis corresponding to frame count values and a second axis corresponding to the seed values, wherein each mask matrix of the plurality of mask matrices corresponds to a different pair of frame count and seed values, and the dithering processing unit selects a mask matrix which corresponds to the pair of frame count and seed values.

10. An image signal processing method comprising:

producing seed values for frames input for a predetermined period, by using a linear feedback shift register (LFSR); and performing a dithering to input image signals by using the produced seed values, wherein the seed values produced by the LFSR are used to determine mask matrices from a plurality of mask matrices, the determined mask matrices are used to perform the dithering to produce dithered image signals, and the producing seed values comprises producing an initial value of the LFSR which produces the seed values based on the initial value, the producing the initial value comprising:

continuously counting a number of frames input, from the input image signals;

dividing the number of frames by a predetermined period; and updating the initial value to produce a new initial value each time a remainder of the number of frames divided by the predetermined period is zero.

11. The method of claim 10, wherein the producing the seed values comprises producing the seed values for the frames input for the predetermined period to be identical to one another.

12. The method of claim 10, wherein the producing the seed values comprises changing the seed values by updating the initial value of the LFSR.

13. The method of claim 12, wherein the producing the seed values comprises updating the initial value of the LFSR if a new frame is determined as input.

14. The method of claim 10, wherein the producing the seed values comprises controlling the LFSR to perform an exclusive OR (XOR) function and to output the seed values according to position changes of pixels included in at least one frame.

15. The method of claim 10, wherein the performing the dithering comprises selecting mask matrixes for dithering the input image signals by using frame counting values obtained by counting a number of the frames of the input image signals and the seed values.

16. The method of claim 10, wherein the producing the seed values comprises:

producing the same initial value for one period; and registering the produced initial value in the LFSR and producing seed values according to position changes of respective pixels included in one frame.

17. The method of claim 10, wherein the performing the dithering comprises:

continuously counting the number of frames from the input image signals and generating a frame count value; and selecting the selected mask matrices from the plurality of mask matrices which correspond to both the frame count value and the seed values.

18. The method of claim 17, wherein the plurality of mask matrices are arranged in a matrix comprising a first axis corresponding to frame count values and a second axis corresponding to the seed values, wherein each mask matrix of the plurality of mask matrices corresponds to a different pair of frame count and seed values, and a selected mask matrix corresponds to the pair of frame count and seed values.

* * * * *